US005725364A

United States Patent [19]

Mirazita

[11] Patent Number: 5,725,364

[45] Date of Patent: Mar. 10, 1998

[54] PRESSURE CONTROL MODULE

[75] Inventor: Frank G. Mirazita, Coon Rapids, Minn.

[73] Assignee: Wagner Spray Tech Corporation, Minneapolis, Minn.

[21] Appl. No.: 594,026

[22] Filed: Feb. 20, 1996

[51] Int. Cl.[6] ..... F04B 49/06

[52] U.S. Cl. ..... 417/44.2; 417/234; 137/884; 200/82 C

[58] Field of Search ..... 417/44.2, 234, 417/307, 308; 137/884; 200/82 A, 82 C; 73/146–8, 745

[56] References Cited

U.S. PATENT DOCUMENTS

| | | | |
|---|---|---|---|
| 3,025,878 | 3/1962 | Hupp | 137/884 |
| 3,614,352 | 10/1971 | Wiese | 200/82 C |
| 4,009,971 | 3/1977 | Krohn | 417/43 |
| 4,095,864 | 6/1978 | Hardin | 137/884 |
| 4,212,591 | 7/1980 | Lamontagne | 417/38 |
| 4,323,741 | 4/1982 | Krohn | 200/81.9 R |
| 4,335,999 | 6/1982 | Lamontagne | 417/38 |
| 4,616,978 | 10/1986 | Matheson | 417/2 |
| 4,669,960 | 6/1987 | Allen | 417/63 |
| 4,768,929 | 9/1988 | Geberth | 417/305 |
| 4,768,932 | 9/1988 | Geberth | 417/552 |
| 4,776,368 | 10/1988 | Drozd | 137/505.43 |
| 4,850,513 | 7/1989 | Porter | 222/1 |
| 4,887,645 | 12/1989 | Kerger | 137/884 |
| 5,059,099 | 10/1991 | Cyphers | 417/311 |
| 5,192,425 | 3/1993 | Cyphers | 210/90 |
| 5,292,232 | 3/1994 | Krohn | 417/44 A |
| 5,316,445 | 5/1994 | Snetting | 417/53 |
| 5,471,959 | 12/1995 | Sturman | 123/447 |
| 5,472,318 | 12/1995 | Frank et al. | 417/306 |

OTHER PUBLICATIONS

Graco Instructions–Part List 308–548, 390sts Airless Paint Sprayer;1994, Minneapolis, MN.

Glidden Operation Manual and Parts List for Power Pup 4 & 5; Dec. 1993, Moorpark, CA.

Titan Owners Manual 313–006, Epic 440e; 1994 Oakland, NJ.

Wagner EP2300 Piston Pump Owner's Manual, pp. 25 and 27; 1994 Minneapolis, MN.

*Primary Examiner*—Timothy Thorpe
*Assistant Examiner*—Xuan M. Thai
*Attorney, Agent, or Firm*—Faegre & Benson

[57] ABSTRACT

Paint spraying equipment having an electric motor, gear reducer and fluid section for pressurizing paint and a pressure control module utilizing a combined fluid manifold and pressure control component mounting frame formed of a single die casting and including an access port for servicing a pressure transducer and further including a paint relief aperture in the cover for directing leakage of paint to the exterior of the assembly.

26 Claims, 6 Drawing Sheets

PRESSURE CONTROL MODULE

FIELD OF THE INVENTION

This invention relates to the field of portable paint spraying equipment, and particularly to portable paint pumps for airless paint spraying and the like.

BACKGROUND OF THE INVENTION

In the past, portable paint spray pumps had relatively complicated pressure control assemblies and required the interconnection of various piping or high pressure hoses to provide for the necessary input, output, overpressure relief, priming and pressure sensing needed with such systems. Such arrangements were costly due to the many parts and need for labor to assemble the parts into the desired configuration. The present invention overcomes such disadvantages of the prior art by providing a component mounting frame, control cover and fluid manifold all formed from a single die casting. The interior of the cover provides a convenient frame or base on which to mount the pressure control elements and, together with the integral fluid manifold, provides simple, convenient, and inexpensive access to the control and fluid components. Additionally, when the components are attached to the frame, the apparatus forms a self-contained pressure control module which is easy to install and remove as a unit (and provides easy access to service individual components) for a portable spray paint pump assembly.

DETAILED DESCRIPTION

Figure 1:
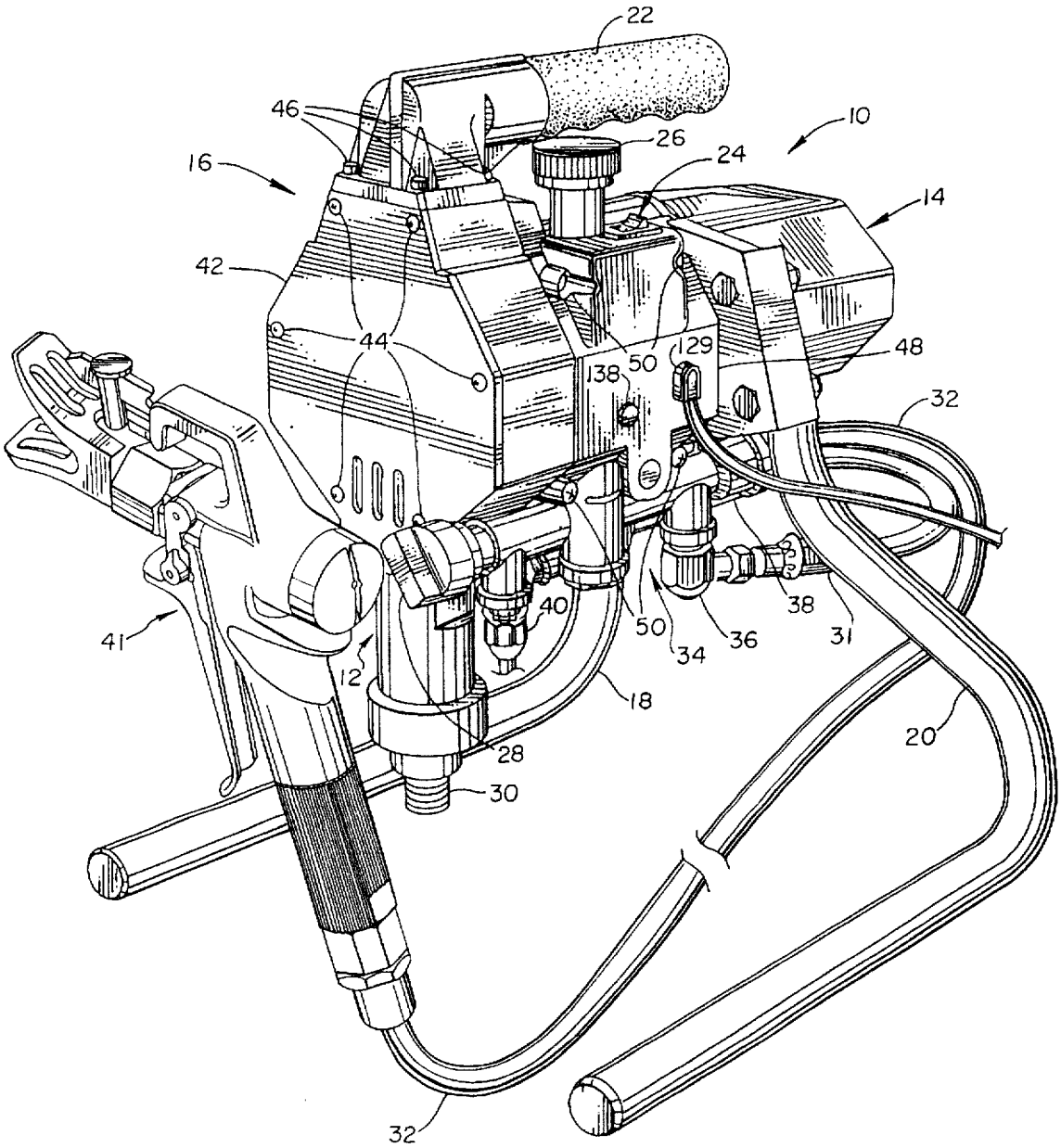
FIG. 1 is a perspective view of a pump assembly useful in the practice of the present invention.

Referring now to the Figures, and most particularly to FIG. 1, a perspective view of a pump assembly 10 useful in the practice of the present invention may be seen. Pump assembly 10 includes a fluid section 12 driven by an electric motor (not shown) enclosed by a housing 14. The motor powers a gear box in housing 16 which also has a rotary to linear motion converting mechanism such as a Scotch yoke contained therein to provide reciprocating linear motion to drive the fluid section 12. Pump 10 preferably has a pair of feet or supports 18, 20 and a handle 22 for portability of the pump 10. Pump 10 further preferably has an on/off switch 24, a manually operable pressure setting or control knob 26, and a priming control 28. In operation, paint is drawn into an inlet 30 of the fluid section, and raised to a high pressure of 2000–3000 p.s.i. by the fluid section 12 delivering the pressurized paint via a hose 31 to a fluid manifold 34 via a fluid coupling 36. The fluid manifold 34 has a paint outlet 38 for connection to another fluid hose 32 similar to hose 31 which, in turn, is connected to a hand-held paint spray gun 41 for application of paint to a surface to be coated. Priming control 28 allows paint to be delivered to a bypass line 40 during priming and also in the event of an over-pressure situation, since the priming control 28 also includes a relief valve for an over-pressure condition in fluid manifold 34. It is to be understood that bypass line 40 will return paint to a reservoir or bucket (not shown) from which paint is drawn by inlet 30.

Housing 16 preferably has a cover 42 secured by a plurality of fasteners 44. Similarly handle 22 is secured to housing 16 by fasteners 46. A control cover 48 is preferably formed integrally with the fluid manifold 34 from a single aluminum die casting and is secured to housing 16 by a plurality of conventional threaded fasteners (not shown) received in recesses 50. It is to be understood that pressure control cover 48 performs a variety of functions as will now be explained.

Figure 2:
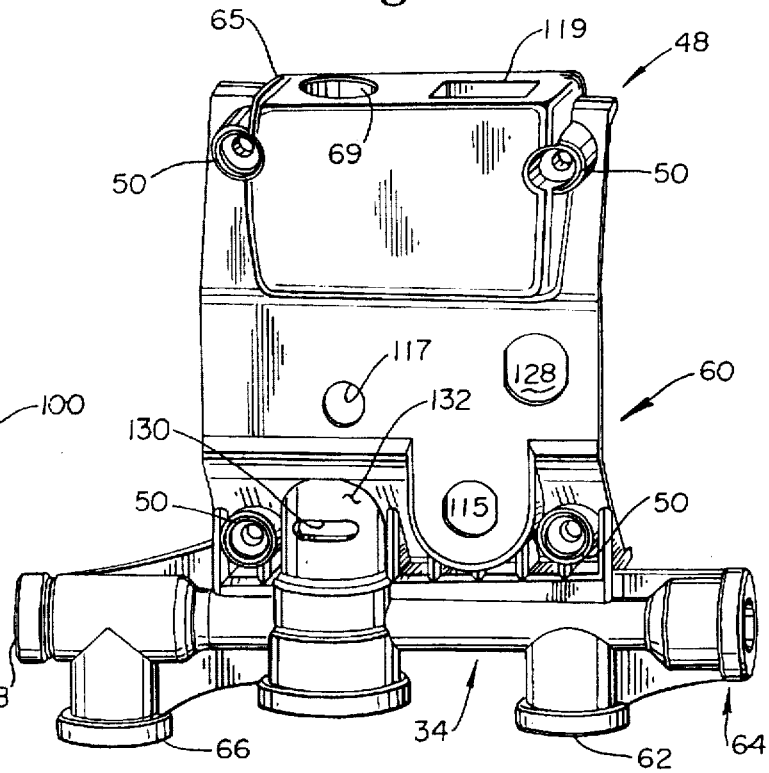
FIG. 2 is a perspective view from slightly above and to the right of the exterior of a first embodiment of a combined fluid manifold and pressure control component mounting frame useful in the practice of the present invention.
Figure 3:
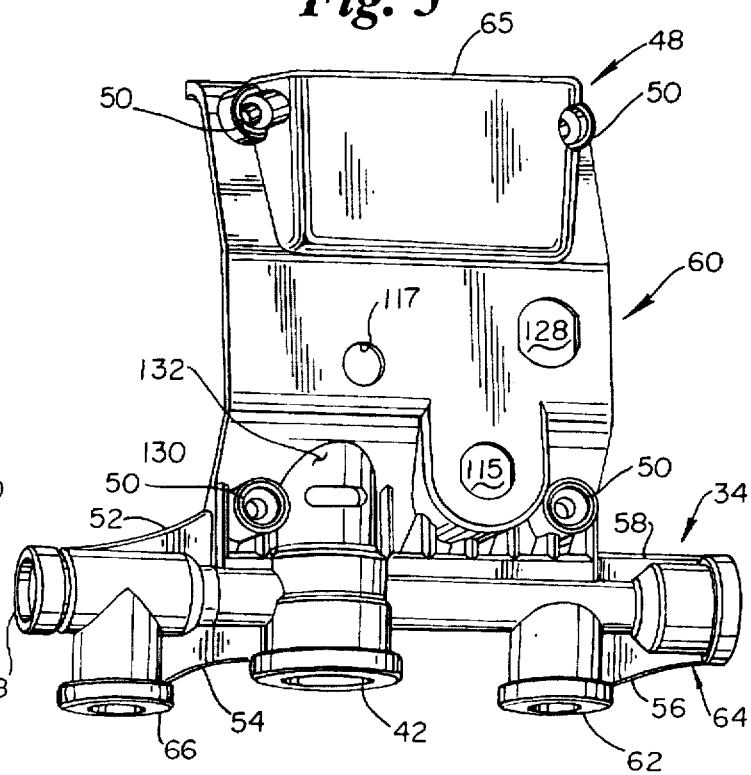
FIG. 3 is a perspective view from slightly below and to the left of the exterior of the combined fluid manifold and pressure control component mounting frame shown in FIG. 2.
Figure 4:
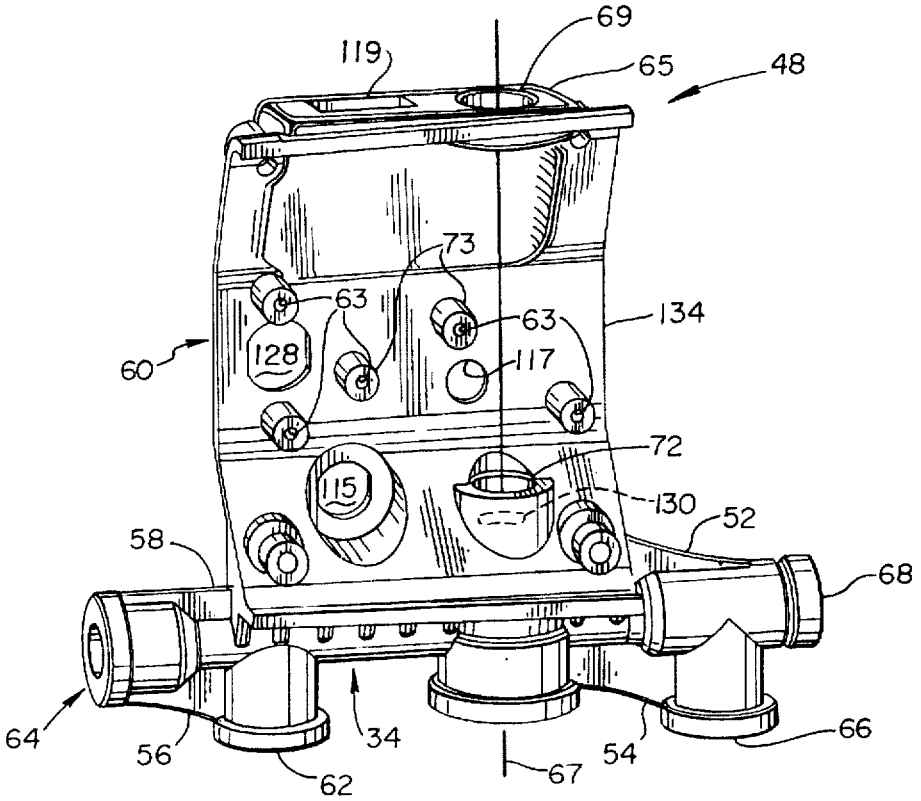
FIG. 4 is a view similar to that of FIG. 2 but from slightly above and to the left of the interior of the combined fluid manifold and pressure control component mounting frame of FIG. 2.

Referring now to FIGS. 2, 3, and 4, the unitary, single die cast part 48 (preferably formed of aluminum) in addition to being a cover, also forms a pressure control mounting frame 60 integral with fluid manifold 34. It is to be understood that, while die casting is preferred, the present invention may be carried out by other forms of manufacturing which emcompass, but are not limited to other forms of casting the single metal part which forms the present invention. The term "metal casting" as used herein is intended to cover all forms of manufacturing such a single metal part.

The fluid manifold 34 has an inlet port 62 (for connection to line 31 via coupling 36), an outlet port 64 (for paint outlet 38) and an overpressure and bypass port 66 (for connection to bypass line 40). In addition, manifold 34 has a port or first recess 68 for mounting an overpressure relief valve 70 which also functions as a priming control using bypass port 66 and bypass line 40 to deliver paint back to the reservoir (not shown) from which it was originally drawn via fluid section inlet 30. Fluid manifold also preferably has a plurality of web sections 52–58, with webs 52 and 54 supporting the valve recess 68 and the bypass port 66, and webs 56 and 58 supporting the inlet port 62 and the outlet port 64. Web 54 also provides support for the pressure transducer access port 92. Webs 52–58 have been found desirable to stiffen the fluid manifold 34 during machining of the recesses in the respective ports therein. It is to be understood that the inlet port 62, outlet port 64, bypass port 66, valve recess 86, and transducer recess 72 are all in fluid communication with each other via suitable passageways within fluid manifold 34.

Figure 6:
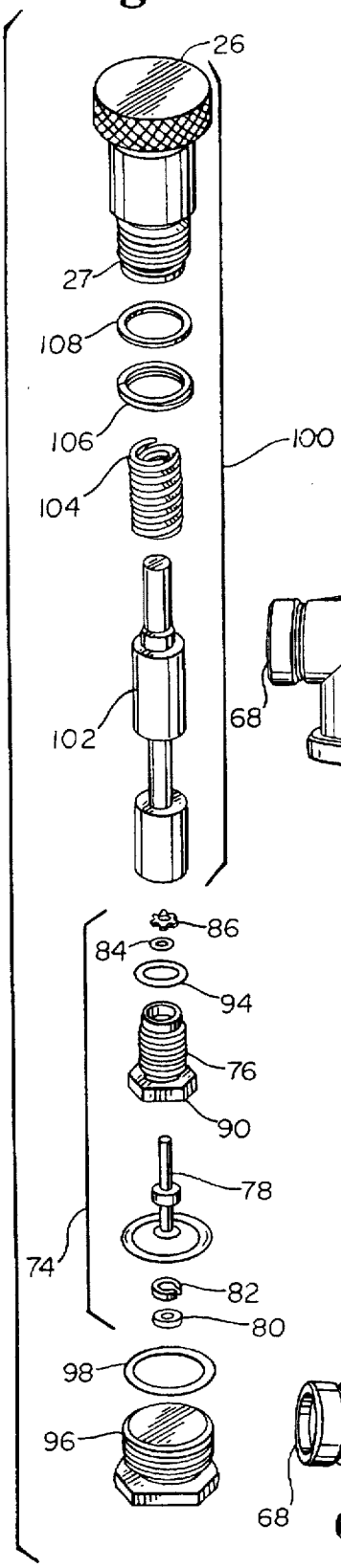
FIG. 6 is an exploded view of the components of the pressure control and pressure transducer subsystems shown in FIG. 5.
Figure 5:
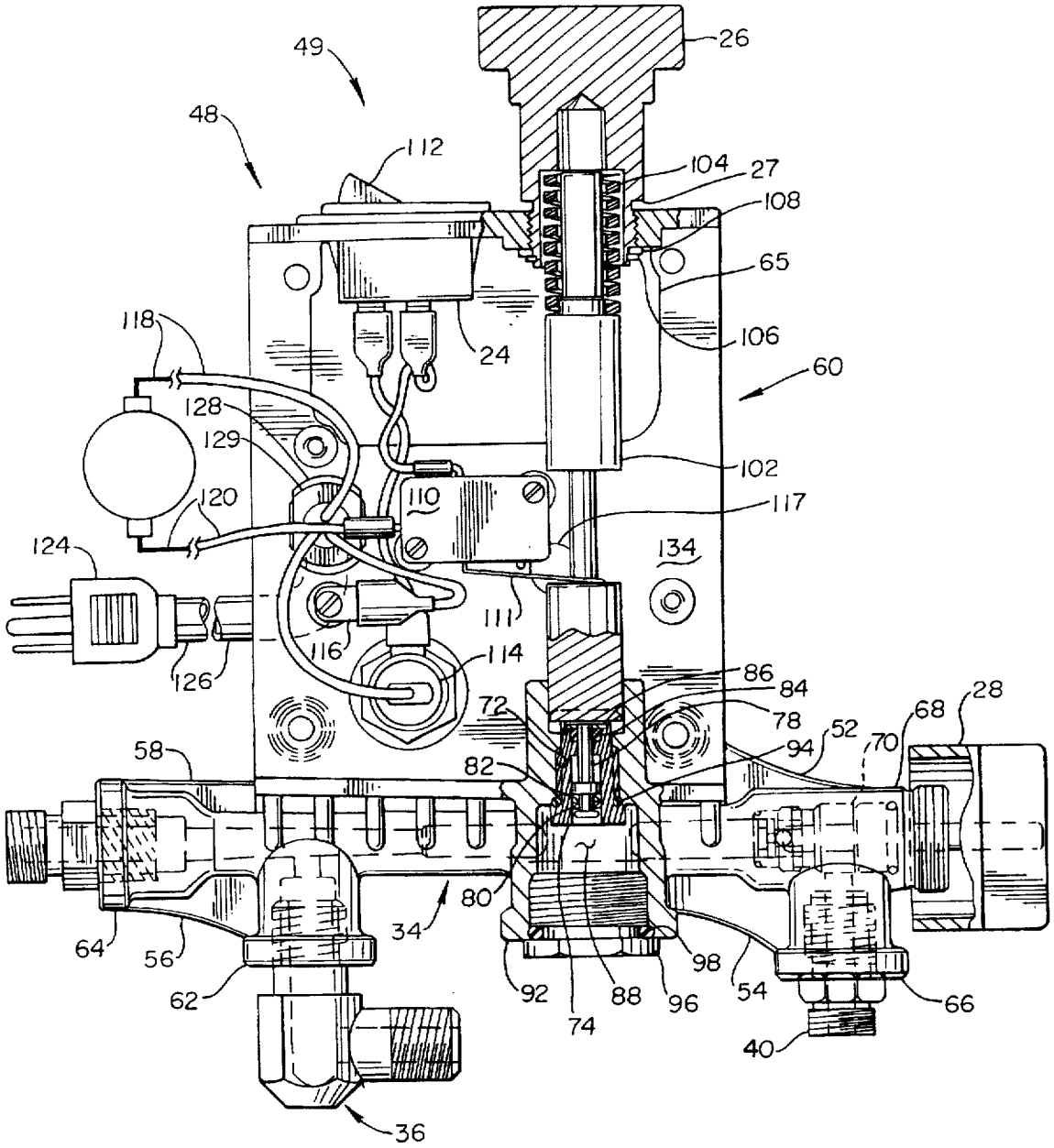
FIG. 5 is an interior elevation view of a pressure control module showing components mounted on the combined fluid manifold and mounting frame of FIG. 2.
Figure 8:
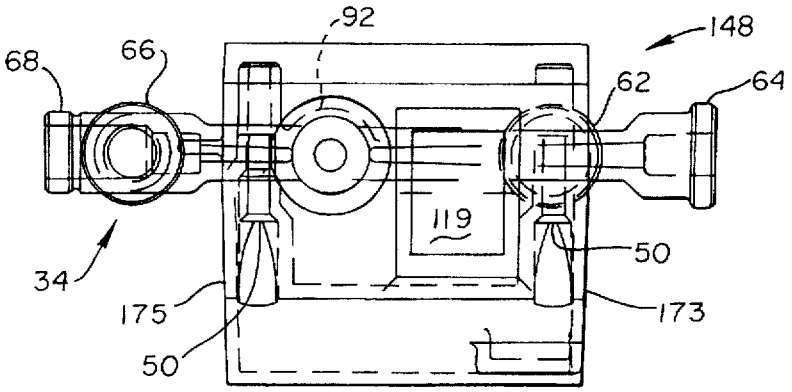
FIG. 8 is a top view of a second embodiment of the combined fluid manifold and pressure control component mounting frame useful in the practice of the present invention.
Figure 9:
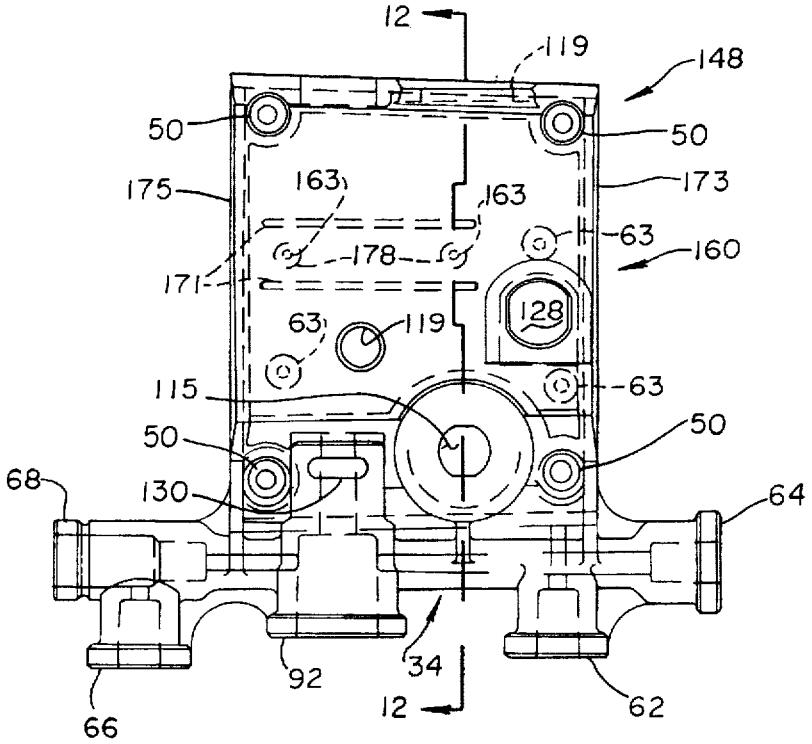
FIG. 9 is a side elevation view of the exterior of the combined fluid manifold and pressure control component mounting frame of FIG. 8.
Figure 10:
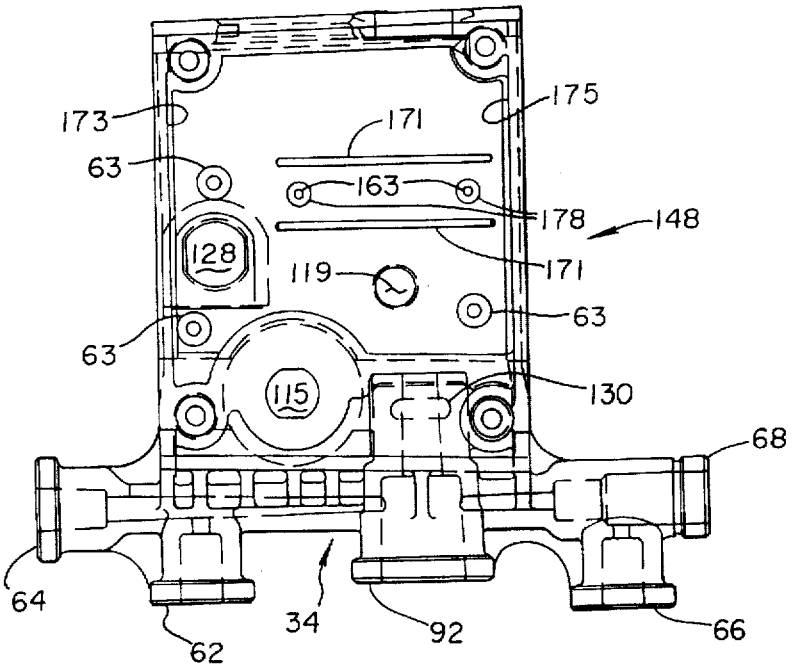
FIG. 10 is an end elevation view of the combined fluid manifold and pressure control component mounting frame of FIG. 8.
Figure 12:
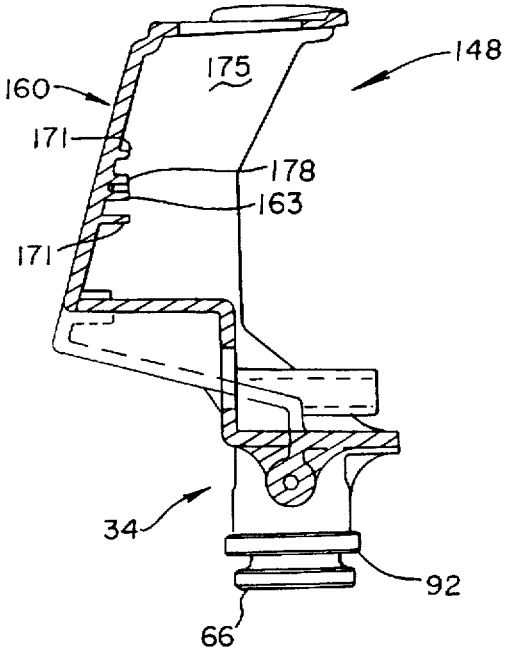
FIG. 12 is a partial section view of the second embodiment combined fluid manifold and pressure control component mounting frame taken along line 12—12 of FIG. 11.
Figure 11:
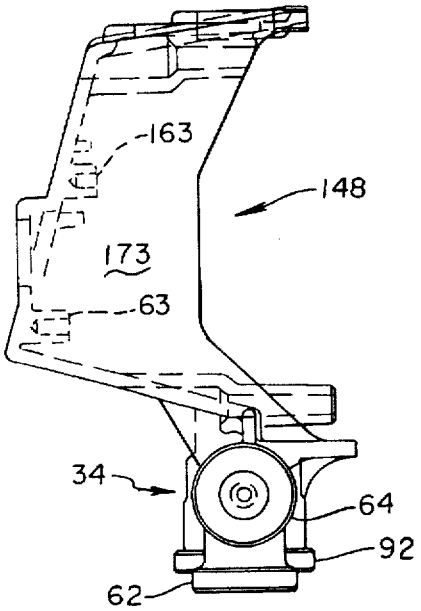
FIG. 11 is a side elevation view of the interior of the combined fluid manifold and pressure control component mounting frame of FIG. 8.

Referring now also to FIGS. 5 and 6, fluid manifold 34 also has a second or transducer recess 72 for mounting a pressure transducer assembly 74. Cover or frame 60 has a plurality of apertures 63 for mounting pressure control components to frame 60. Frame 60 also has a projecting portion or boss 65 for mounting the pressure control knob 26 in alignment with the recess 72 for the pressure transducer 74 along a pressure control axis 67. Boss 65 also preferably includes an aperture 119 for mounting switch 24. It is also to be noted that aperture 69 in boss or second wall portion 65 is located a predetermined distance away from the pressure transducer assembly 74 along their common axis 67.

Referring now more particularly to FIG. 6, pressure transducer assembly 74 includes an externally threaded case or body 76, a piston 78, a primary seal O-ring 80, a backup ring 82, a secondary seal O-ring 84, and a metal retaining ring 86. It is to be understood that piston 78 is free to move axially in housing 76 in response to pressure changes in the interior passageways 88 of fluid manifold 34. O-rings 80 and 84 and backup ring 82 are designed to prevent leakage of paint past piston 78 interior of transducer housing 76. Retaining ring 86 is sized to grip the interior bore of case 76 to prevent backup O-ring 84 from being driven out of case 76 by movement of piston 78. Case 76 preferably has a hexagonal end 90 to permit installation of transducer assembly 74 through an access port or opening 92 in fluid manifold 34. Transducer assembly 74 may be carried and installed (or removed for service) by a conventional socket wrench extending through opening 92 into second recess 72 (see FIG. 5). A pressure transducer case O-ring 94 is preferably used to seal the leakage path exterior of case 76 in recess 72. A plug 96 and plug O-ring 98 are preferably used to seal the opening or port 92 after installation or service of transducer assembly 74.

Figure 7:
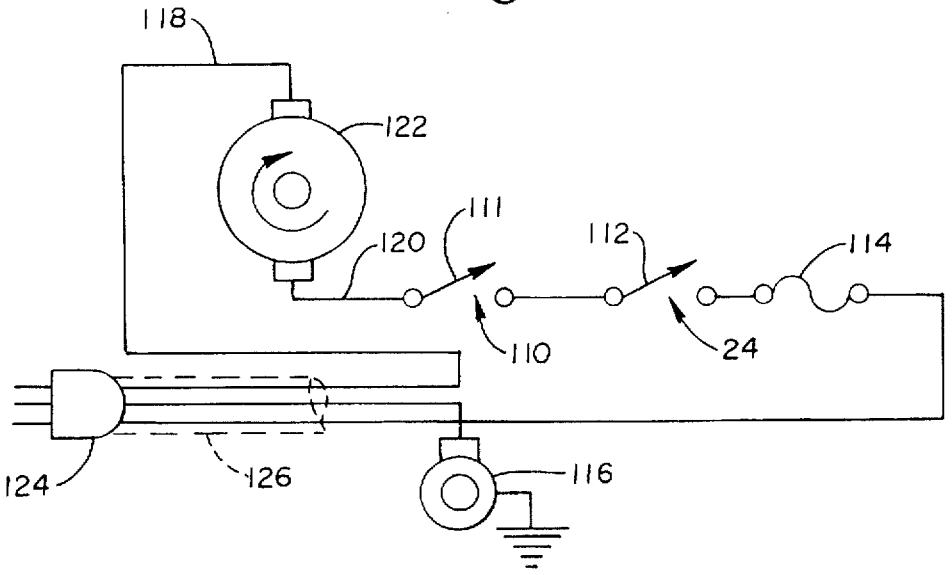
FIG. 7 is an electrical schematic for the pressure control module of FIG. 5.

In addition to the pressure setting knob 26, parts for a pressure control apparatus 100 useful in the practice of the present invention include a plunger 102, a compression spring 104, a retaining ring 106 and a washer 108. Referring now also to FIG. 7, the pressure control 100 also preferably includes an electrical switch 110 actuatable by movement of the plunger 102. It is to be understood that switch 110 is a Normally-Closed type and is opened via an actuator 111 when plunger 102 is driven against spring 104 by piston 78 in response to an increase in pressure in fluid manifold 34, as will be described more fully below. Switch 110 is preferably mounted to the die casting by two projections 73, each having a blind bore or aperture 63 therein. The remaining electrical components completing a pressure control module assembly 49 and which are mounted on frame 60 include the ON-OFF switch 24 having a manually operable actuator 112, a fuse 114 and a ground connection 116. Fuse 114 is to be understood to include a conventional insulating fuse holder and is preferably mounted to the die casting 48 via a fuse aperture 115 in the die casting. In addition, a maximum pressure adjustment aperture 117 is provided in die cast cover 48 adjacent actuator 111 to permit access to actuator 111 which is preferably manually deformed during calibration of the system 10 to set the maximum pressure obtainable when knob 26 is at the end of its travel where a shoulder 27 on knob 26 contacts boss 65 of the housing 48. Once the maximum pressure setting is accomplished, aperture 117 is preferably closed by a snap in cover or plug 138.

As has been mentioned, die cast frame 48 also includes a preferably rectangular aperture 119 to serve as means for mounting the manually operable ON-OFF power switch 24. Wires 118, 120 are connected to a motor (shown schematically as element 122 in FIG. 7) driving the piston pump in fluid section 12 to pressurize the paint or other fluid delivered to fluid manifold 34. Electrical power is preferably supplied via a plug 124 and power cord 126 which is mounted in an aperture 128 via a conventional strain relief 129.

In operation, when the system 10 is connected to an electrical power source and switch 24 is turned ON via actuator 112, switch 110 will initially be (normally) closed, and motor 122 will be energized, powering the piston pump in fluid section 12, which is normally a double acting piston having inlet and outlet check valves and is capable of achieving the desired fluid pressures. Pressure will build up in the interior 88 of fluid manifold 34 until sufficient force urges piston 78 to move against plunger 102 and spring 104. Once the desired pressure is reached, (as set by knob 26 compressing balance spring 104 to urge plunger 102 away therefrom) piston 78 will move plunger 102 sufficiently to counterbalance the force exerted on piston 78 by the fluid pressure in passageways 88. In this condition, piston 78 will move plunger 102 sufficiently to deactuate switch 110 to the OFF or open circuit position, shutting off motor 122 until the pressure drops, allowing spring 104 to move plunger 102 and close switch 110.

As the seals on piston 78 wear, leakage will occur. To prevent the ingress of paint into the interior of cover 48 where it would interfere with the electrical and pressure control components, a relief aperture 130 is provided in a transition wall 132 adjacent an output end of transducer assembly 74 and opening to the exterior of cover or housing 48 for directing any paint leaking from the pressure transducer assembly to exit to the exterior of the die casting, to avoid contamination of the pressure control components. It is to be understood that transition wall 132 extends from the fluid manifold 34 to a first wall section 134 of the cover 48, and the second recess 72 in fluid manifold 34 is in the form of a cylinder having an upper end 136 interior of the cover 48, forming a dam to prevent ingress of paint from recess 72 into the interior of cover 48. Any paint leaking past the piston 78 will be retained by dam 136 while exiting the housing 48 via relief aperture 130, thus directing any such leakage to the exterior of module 49 and alerting the operator that the transducer assembly 74 needs service. The upper edge of dam 136 is preferably parallel to boss or second wall section 65 in which a threaded aperture 69 is located for mounting the pressure control knob 26. Once the pressure control components are assembled to frame 48, the apparatus forms the complete pressure control module assembly 49 shown in FIG. 5.

As has been referred to previously, removal of the pressure transducer 74 for service can be easily accomplished by removing plug 96 and thereafter disengaging transducer assembly 74 from fluid manifold 34 by using a socket wrench on hexagonal head 90 to unscrew case 76 from recess 72. Transducer assembly 74 can then be rebuilt or replaced as desired, with the plug 96 and seal ring 98 being reinstalled (or replaced) after service of transducer assembly 74. This arrangement eliminates the time consuming and relatively more complex dismantling and reassembly of separate parts and piping ordinarily found in prior art pressure transducer assemblies.

Referring now to FIGS. 8–12, a second embodiment of a control cover 148 may be seen. In this embodiment, like reference numbers have been used to indicate like parts or portions corresponding to the first embodiment. Cover 148 may be seen to be deeper than cover 48. Cover 148 also has additional bosses 173 with blind bores 163 and spacers 171 for mounting an electrical terminal block (not shown) for making connections electrically isolated from frame 160. Finally, cover 148 has a pair of end walls 173, 175 to completely enclose the interior thereof.

The invention is not to be taken as limited to all of the details thereof as modifications and variations thereof may be made without departing from the spirit or scope of the invention.

What is claimed is:

1. A pressure control module comprising a. a fluid manifold having an inlet port, an outlet port, and a transducer recess for mounting a pressure transducer, wherein the inlet port, outlet port and transducer recess are in fluid communication with each other; and b. a pressure control mounting frame having a wall section forming a cover with an aperture located therein for mounting a pressure control apparatus on a common axis with the transducer recess wherein the fluid manifold and pressure control mounting frame are formed of a single die-cast aluminum part.

2. The module of claim 1 wherein the fluid manifold further comprises an access port aligned with the transducer recess to enable installation and removal of a pressure transducer from the fluid manifold without disassembly of the pressure control apparatus from the control cover and frame.

3. The module of claim 2 further comprising a removable plug received in the access port to permit servicing the pressure transducer.

4. The module of claim 1 wherein the fluid manifold further comprises a valve recess in fluid communication with the inlet port, outlet port and transducer recess.

5. The module of claim 4 wherein the fluid manifold further comprises a bypass port in fluid communication with the valve recess.

6. The module of claim 5 further comprising an overpressure relief valve mounted in the valve recess such that the overpressure relief valve selectively opens fluid communication to the bypass port.

7. The module of claim 1 further comprising a pressure transducer received in the transducer recess.

8. The module of claim 7 further comprising a pressure control apparatus mounted in the pressure control mounting frame and connected to the pressure transducer.

9. The module of claim 8 wherein the pressure control apparatus further comprises a manually operable pressure control knob received in and projecting through the aperture in the control cover and frame.

10. The module of claim 8 wherein the pressure control apparatus further comprises an electrical switch for turning a pump on and off in response to the pressure control apparatus to regulate the pressure in the fluid manifold.

11. A pressure control module for a portable piston paint pump comprising a. a single unitary metal casting including i. a fluid manifold having an inlet port, an outlet port, an overpressure and bypass port, and a transducer recess all in fluid communication therebetween;

ii. a wall section;

b. a pressure transducer assembly received in the transducer recess; and c. a pressure control apparatus supported by the wall section in alignment with the pressure transducer assembly.

12. The module of claim 11 wherein the pressure control apparatus comprises a manually rotatable pressure control knob projecting exteriorly of the wall section.

13. The module of claim 12 wherein the pressure control apparatus further comprises a plunger aligned with the pressure control knob and a spring biasing the plunger away from the knob to balance against a force developed by the pressure transducer assembly and acting against the plunger, wherein the plunger is located intermediate the spring and the transducer assembly.

14. The module of claim 13 wherein the pressure control apparatus further includes an electrical switch having an actuator thereon and the die casting further comprises means for mounting the switch adjacent the plunger with the actuator responsive to the position of the plunger to turn the electrical switch on and off.

15. The module of claim 14 wherein the die casting further comprises an aperture adjacent the actuator of the electrical switch for permitting access thereto to adjust the pressure at which the switch actuates.

16. The module of claim 11 wherein the pressure transducer assembly further comprises a piston in fluid communication with pressure interior of the fluid manifold.

17. The module of claim 11 wherein the fluid manifold further comprises an access port aligned with the recess for installing and removing the pressure transducer assembly.

18. The module of claim 11 wherein the casting further includes a relief aperture adjacent the pressure transducer assembly for directing paint leaking from the pressure transducer assembly to exit to the exterior of the casting via the relief aperture.

19. The module of claim 11 wherein the die casting further comprises a fuse aperture for mounting an electrical fuse.

20. The module of claim 11 wherein the wall section of the die casting further comprises means for mounting a manually operable power switch.

21. A pressure control module comprising a. a single cast metal part which includes i. a fluid manifold having a paint inlet port, a paint outlet port, a bypass and priming port, a valve recess, and a transducer recess all in fluid communication with each other via interior passageways; and ii. a pressure control component mounting frame having a first wall section including means for mounting pressure control components therein, and a second wall section including an aperture for mounting a pressure control knob aligned with the transducer recess wherein the apertures for the pressure control knob and pressure transducer are concentrically aligned on a common axis and spaced a predetermined axial distance apart.

22. The module of claim 21 further comprising a transition wall between the fluid manifold and the first wall section, the transition wall having a relief aperture therein generally adjacent the transducer aperture for directing paint leaking through the pressure transducer to exit to the exterior of the module.

23. The module of claim 21 wherein the cast metal part further comprises iii. a cover for enclosing pressure control components mounted on the mounting frame.

24. The module of claim 21 further comprising b. a pressure transducer mounted in the transducer recess; and c. a pressure control apparatus including i. a pressure control knob threaded into the aperture therefor, and ii. a balance spring and plunger located between the knob and pressure transducer such that the plunger will move against the balance spring in response to pressure increases signaled by the pressure transducer.

25. The module of claim 24 wherein the pressure control apparatus further comprises an electrical switch actuated by movement of the plunger.

26. A portable piston paint pump assembly comprising a. pump means for pressurizing paint;

b. spray gun means connected to the pump means for atomizing the pressurized paint; and b. a pressure control module connected to the pump means and including i. a combined pressure control component mounting frame and a fluid manifold in fluid communication with the pressurized paint, ii. an overpressure relief valve and priming control mounted in the fluid manifold, iii. a pressure transducer mounted in the fluid manifold and having an input exposed to the pressurized paint interior of the fluid manifold and an output exterior of the fluid manifold and interior of the module, and iv. a pressure control apparatus mounted on the mounting frame and coupled to the output of the pressure transducer, wherein the pressure control includes a pressure adjustment knob rotatably mounted to the mounting frame to permit manual adjustment of a pressure setting for the pressure control wherein the combined pressure control component mounting frame and fluid manifold is formed of a single metal casting.

* * * * *